US012781148B2

(12) United States Patent
Tort et al.

(10) Patent No.: US 12,781,148 B2
(45) Date of Patent: Nov. 3, 2026

(54) HYDROGEN SULPHIDE AND MERCAPTANS SCAVENGING COMPOSITIONS

(71) Applicant: TOTALENERGIES ONETECH, Courbevoie (FR)

(72) Inventors: Frédéric Tort, Givors (FR); Hemant Mondkar, Navi Mumbai (IN)

(73) Assignee: TOTALENERGIES ONETECH, Courbevoie (FR)

( * ) Notice: Subject to any disclaimer, the term of this patent is extended or adjusted under 35 U.S.C. 154(b) by 633 days.

(21) Appl. No.: 18/256,088

(22) PCT Filed: Dec. 9, 2021

(86) PCT No.: PCT/EP2021/084893
§ 371 (c)(1),
(2) Date: Jun. 6, 2023

(87) PCT Pub. No.: WO2022/122865
PCT Pub. Date: Jun. 16, 2022

(65) Prior Publication Data

US 2024/0043762 A1 Feb. 8, 2024

(30) Foreign Application Priority Data

Dec. 11, 2020 (EP) ..... 20306550

(51) Int. Cl.
*C10L 3/10* (2006.01)
*C10L 1/222* (2006.01)
*C10L 1/233* (2006.01)

(52) U.S. Cl.
CPC ..... *C10L 3/103* (2013.01); *C10L 1/2225* (2013.01); *C10L 1/233* (2013.01); *C10G 2300/207* (2013.01)

(58) Field of Classification Search
CPC ..... C10L 2290/54; C10L 2290/545; C10L 3/103; C10G 2300/207
See application file for complete search history.

(56) References Cited

U.S. PATENT DOCUMENTS 2,776,870 A * 1/1957 Fischer ..... C23F 11/06 252/392
4,978,512 A * 12/1990 Dillon ..... C10L 3/10 208/189
6,117,310 A * 9/2000 Rivers ..... C10L 3/10 585/860
2013/0004393 A1* 1/2013 Menendez ..... B01D 53/52 210/749
2018/0371334 A1 12/2018 Beilfuss et al.
2020/0109329 A1* 4/2020 de Oliveira Filho .. C09K 8/532
2020/0157439 A1* 5/2020 de Oliveira Filho .. B01D 53/52

FOREIGN PATENT DOCUMENTS

RU 2008150509 A * 6/2010

OTHER PUBLICATIONS

Machine Translation of Abstract of RU2008150509A (Year: 2008).*

* cited by examiner

*Primary Examiner* — Ellen M Mcavoy
*Assistant Examiner* — Ming Cheung Po
(74) *Attorney, Agent, or Firm* — Boyle Fredrickson S.C.

(57) ABSTRACT

The present invention relates to a composition for scavenging hydrogen sulphide and/or mercaptans in hydrocarbon streams, the composition comprising at least one oxazolidine compounds and at least one alkanolamine allowing boosting the effect of the oxazolidine compound.

17 Claims, 5 Drawing Sheets

HYDROGEN SULPHIDE AND MERCAPTANS SCAVENGING COMPOSITIONS

TECHNICAL FIELD

The present invention pertains to a novel hydrogen sulphide and mercaptans scavenging composition comprising an oxazolidine compound and an alkanolamine. The present invention also pertains to the use of an alkanolamine to improve the efficiency of an oxazolidine compound for scavenging hydrogen sulphide and/or mercaptans in hydrocarbon streams, and in particular for increasing the duration of this scavenging and accelerating the scavenging. The present invention also relates to a method for scavenging hydrogen sulphide and/or mercaptans comprising contacting a hydrocarbon stream such as crude oil, fuel or natural gas with the scavenging composition of the invention.

BACKGROUND OF THE INVENTION

Hydrogen sulphide is a colourless and fairly toxic, flammable and corrosive gas which also has a characteristic odour at a very low concentration. Hydrogen sulphide dissolves in hydrocarbon and water streams and is also found in the vapour phase above these streams and in natural gas. The hydrogen sulphide emissions can therefore be a nuisance to workers operating in the production, transport, storage, and processing of crude oil and in the storage of fuel. Hydrogen sulphide may also react with hydrocarbon components present in fuel. It would therefore be desirable for the workers' comfort and safety to reduce or even eliminate the hydrogen sulphide emissions during the manipulation of said products.

Legislation has been in place for years, imposing strict regulations on hydrogen sulphide levels of hydrocarbon streams pipelines, and in storage and shipping containers. A variety of chemical scavengers are available to reduce both the concentration and corresponding hazard of hydrogen sulphide in produced gas, crude oil and refined products. Some of the most common methods for treating hydrogen sulphide include triazine, glyoxal, as well as metal-based scavengers. Glyoxal has been used extensively as hydrogen sulphide scavenger but suffers from a major drawback since aqueous glyoxal solutions are highly corrosive and cannot be used for a gas tower application. Triazines have recently become a more common chemical scavenger used for treating hydrogen sulphide from hydrocarbon streams.

Others hydrogen sulphide scavengers have been developed, and among them scavengers based on oxazolidine, like 3,3'-methylenebis(5-methyloxazolidine), known as MBO. A method for scavenging hydrogen sulphide from sour hydrocarbon substrates has been described in WO 98/02501. MBO presents the advantage to be less toxic and to create no deposits in the conditions where triazine does.

However, this technology either MBO or triazine requires an important contact time in order to be efficient in sulphur removal and thus involves injection of higher doses.

Formulations of MBO with promoters, also named boosters, have been developed to enhance the efficiency of MBO. For example, WO 2017/102693 describes a composition comprising MBO and one or more additive selected among urea, urea derivatives, amino acids, guanidine, guanidine derivatives or 1,2-diols, said composition being used in the removal of sulphur compounds from process streams.

It would be useful to provide a composition further enhancing the $H_2S$ scavenging properties of oxazolidine compounds.

SUMMARY OF THE INVENTION

The present invention relates to a composition for scavenging hydrogen sulphide and mercaptans in hydrocarbon streams, said composition comprising at least one oxazolidine compound and at least one alkanolamine of formula (I), wherein the weight ratio oxazolidine compound/alkanolamine is higher than 1, wherein:

(I)

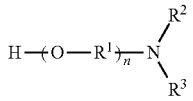

wherein n is an integer ranging from 1 to 6, $R^1$ is a divalent linear or branched, cyclic or acyclic, alkyl or alkenyl group having from 1 to 12 carbon atoms, $R^2$ and $R^3$, identical or different, are selected from a hydrogen atom, a linear or branched, cyclic or acyclic, alkyl or alkenyl group having from 1 to 12 carbon atoms or $—(R^4—O)_m—H$ wherein each m is independently an integer ranging from 1 to 6 and $R^4$ is a divalent linear or branched, acyclic or cyclic, alkyl or alkenyl group having from 1 to 12 carbon atoms.

Preferably, the weight ratio oxazolidine compound/alkanolamine ranges from more than 1 to 20, preferably from 1.2 to 15, more preferably from 1.5 to 10, even more preferably from 2 to 5.

Preferably, the oxazolidine compound is selected from bisoxazolidines of formula (II):

(II)

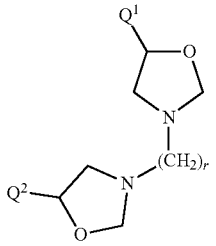

Wherein r is an integer ranging from 1 to 6, preferably from 1 to 2;

$Q^1$ and $Q^2$, identical or different, are selected from a hydrogen atom and a linear, branched or cyclic alkyl or alkenyl groups having from 1 to 6 carbon atoms, preferably from 1 to 2 carbon atoms.

Preferably in formula (I):

n ranges from 1 to 2, $R^1$ is a divalent linear or branched alkyl group having from 2 to 6 carbon atoms, preferably from 2 to 4 carbon atoms, $R^2$ and $R^3$, identical or different, are selected from a hydrogen atom, a linear or branched alkyl group having from 2 to 6 carbon atoms, preferably from 2 to 4 carbon atoms, or from $—(R^4—O)_m—H$ wherein each m is independently an integer ranging from 1 to 2, and $R^4$ is a divalent linear or branched alkyl group having from 2 to 6 carbon atoms, preferably from 2 to 4 carbon atoms.

According to an embodiment, the molecular weight of the alkanolamine ranges from 50 to 300 g/mol, preferably from 55 to 250 g/mol, more preferably from 60 to 200 g/mol.

Preferably, in formula (I):

n is equal to 2 and at least one among $R^2$ and $R^3$ is —$(R^4—O)_m$—H wherein m is 1 or 2, preferably both $R^2$ and $R^3$ are —$(R^4—O)_m$—H wherein m is preferably 1.

According to an embodiment, the alkanolamine is selected from methyldiethanolamine, monoisopropanolamine, polyethanolamine, monoethanolamine, diethanolamine, methylmonoethanolamine, dimethylethanolamine, diethylethanolamine, ethylmonoethanolamine, ethyldiethanolamine, triisopropanolamine, and mixtures thereof, preferably, from methyldiethanolamine, monoisopropanolamine, polyethanolamine, monoethanolamine, diethanolamine, and mixtures thereof, more preferably from methyldiethanolamine, monoisopropanolamine, polyethanolamine, monoethanolamine, and mixtures thereof.

According to an embodiment of the invention, the scavenging composition further comprises at least one solvent, preferably in an amount ranging from 1 to 80% wt, preferably from 5 to 80% wt, more preferably from 10 to 70% wt, based on the total weight of the composition.

Preferably, the scavenging composition according to the invention comprises:

From 10 to 99% wt, preferably from 30 to 98% wt, more preferably from 40 to 95% wt of oxazolidine compound(s), From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition.

Preferably, the scavenging composition according to the invention comprises:

From 10 to 99% wt, preferably from 30 to 98% wt, more preferably from 40 to 95% wt of oxazolidine compound(s), From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition, wherein the weight ratio of oxazolidine compound to alkanolamine of formula (I) ranges from 1.5 to 10, preferably from 2 to 5.

The present invention also relates to the use of an alkanolamine of formula (I), for improving the efficiency of an oxazolidine compound for scavenging hydrogen sulphide and/or mercaptans in hydrocarbon streams, wherein:

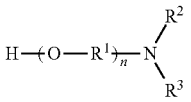

(I)

wherein n is an integer ranging from 1 to 6, $R^1$ is a divalent linear or branched, cyclic or acyclic, alkyl or alkenyl group having from 1 to 12 carbon atoms, $R^2$ and $R^3$, identical or different, are selected from a hydrogen atom, a linear or branched, cyclic or acyclic, alkyl or alkenyl group having from 1 to 12 carbon atoms or —$(R^4—O)_m$—H wherein each m is independently an integer ranging from 1 to 6 and $R^4$ is a divalent linear or branched, acyclic or cyclic, alkyl or alkenyl group having from 1 to 12 carbon atoms.

Preferably, the alkanolamine of formula (I) used according to the invention is as defined in the present invention and/or the oxazolidine compound used according to the invention is as defined in the present invention.

Preferably, the weight ratio oxazolidine compound/alkanolamine is higher than 1, preferably the weight ratio oxazolidine compound/alkanolamine ranges from more than 1 to 20, preferably from 1.2 to 15, more preferably from 1.5 to 10, even more preferably from 2 to 5.

The present invention also relates to a hydrocarbon-containing composition comprising hydrocarbons and a scavenging composition according to the invention, wherein the hydrocarbons are preferably selected from crude oil, fuel oil, fuel, Light Petroleum Gas, natural gas, bitumen and petroleum residues.

Finally, the present invention relates to a method for scavenging hydrogen sulphide and/or mercaptans in a hydrocarbon stream, comprising contacting the hydrocarbon stream with the scavenging composition according to the invention.

The scavenging composition of the present invention enables to reduce the treat rate, i.e. reduce the amount of MBO necessary to scavenge a given amount of hydrogen sulphide from the sulphur containing hydrocarbon stream.

The scavenging composition of the present invention also enables to improve the scavenging properties. The improvement can be seen when the remaining amount of sulphur compounds in the hydrocarbon stream is reduced and/or when the speed of the scavenging of sulphur compounds is increased thanks to the introduction of the scavenging composition according to the invention into the hydrocarbon stream.

The scavenging composition of the present invention allows a faster scavenging, i.e. the amount of sulphur compounds is decreased more rapidly than with prior art scavenging compositions.

DETAILED DESCRIPTION OF THE INVENTION

Figure 1:
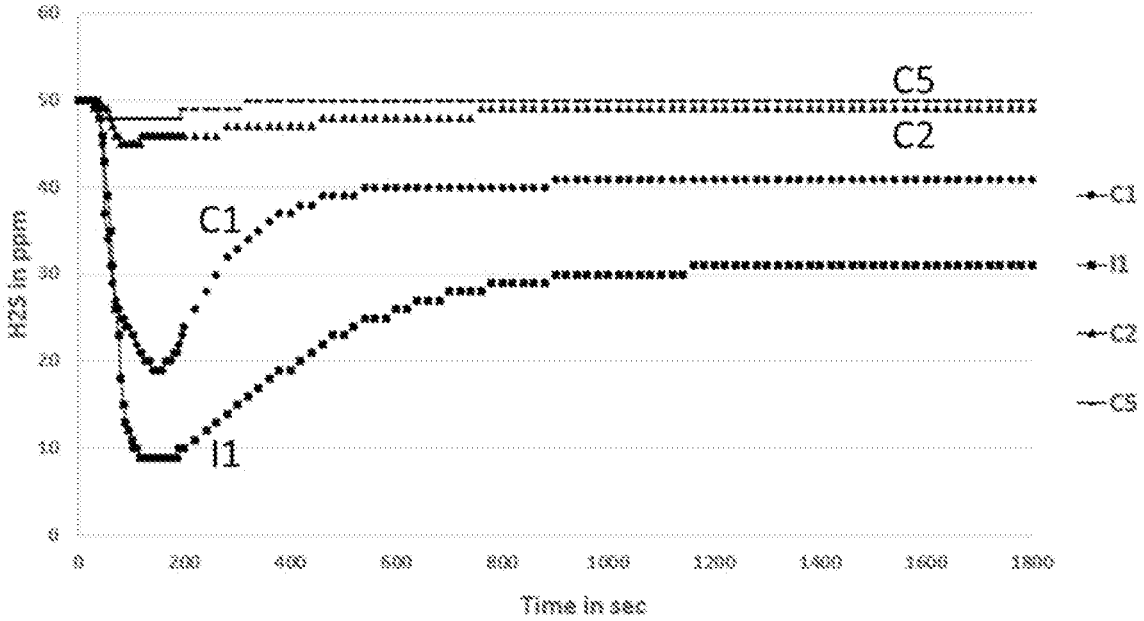
FIG. 1 represents the amount of hydrogen sulphide in ppm in function of the time during the test for different scavenging compositions in a hydrocarbon stream (HC1).

The present invention concerns a composition comprising at least one oxazolidine compound and at least one alkanolamine, wherein the weight ratio oxazolidine/alkanolamine is higher than 1. This composition is also named in the present invention "scavenging composition".

Within the meaning of the present invention, the expression "oxazolidine compound" refers to a compound comprising at least one oxazolidine cycle, said cycle being optionally substituted.

According to a particular embodiment, the oxazolidine compound is selected from bisoxazolidines, i.e. compounds comprising two oxazolidine cycles.

According to a particular embodiment, the oxazolidine compound replies to formula (II):

(II)

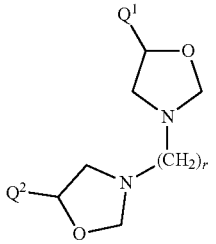

wherein r is an integer ranging from 1 to 6, preferably from 1 to 2;

$Q^1$ and $Q^2$, identical or different, are selected from a hydrogen atom and a linear or branched, cyclic or acyclic, alkyl or alkenyl groups having from 1 to 6 carbon atoms, preferably from 1 to 2 carbon atoms.

Preferably, the oxazolidine compound is 3,3'-methylenebis(5-methyloxazolidine) (MBO).

Within the meaning of the present invention, the term "acyclic alkyl" refers to an alkyl group which does not form part of a cycle.

Within the meaning of the present invention, the term "acyclic alkenyl" refers to an alkenyl group which does not form part of a cycle.

Within the meaning of the present invention, the term "cyclic alkyl" refers to a saturated cycloalkyl group, wherein the cycle can be optionally substituted by one or more linear or branched alkyl or alkenyl groups. Preferably, the cycle comprises 5 or 6 carbon atoms and the substituent(s) if any comprise(s) from 1 to 6 carbon atoms, preferably from 1 to 3 carbon atoms.

Within the meaning of the present invention, the term "cyclic alkenyl" refers to an unsaturated cycloalkyl group, wherein the cycle comprising at least one unsaturation can be optionally substituted by one or more linear or branched alkyl or alkenyl groups. Preferably, the cycle comprises 5 or 6 carbon atoms and the substituent(s) if any comprise(s) from 1 to 6 carbon atoms, preferably from 1 to 3 carbon atoms.

According to the present invention, the alkanolamine replies to formula (I):

(I)

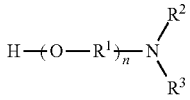

Wherein n is an integer ranging from 1 to 6, preferably from 1 to 4, more preferably from 1 to 2, even more preferably n is equal to 1, $R^1$ is a divalent linear or branched, cyclic or acyclic, alkyl or alkenyl group having from 1 to 12 carbon atoms, preferably from 2 to 6 carbon atoms, $R^2$ and $R^3$, identical or different, are selected from a hydrogen atom, a linear or branched, cyclic or acyclic, alkyl or alkenyl group having from 1 to 12 carbon atoms or $—(R^4—O)_m—H$ wherein each m is independently an integer ranging from 1 to 6, preferably from 1 to 4, more preferably from 1 to 2, even more preferably m is equal to 1 and $R^4$ is a divalent linear or branched, cyclic or acyclic, alkyl or alkenyl group having from 1 to 12 carbon atoms, preferably from 2 to 6 carbon atoms.

Preferably, $R^2$ and $R^3$ are identical.

According to an embodiment, in formula (I):

n is an integer ranging from 1 to 6, preferably from 1 to 4, more preferably from 1 to 2, even more preferably n is equal to 1, $R^1$ is a divalent linear or branched, acyclic, alkyl or alkenyl group having from 1 to 12 carbon atoms, preferably from 2 to 6 carbon atoms, $R^2$ and $R^3$, identical or different, are selected from a hydrogen atom, a linear or branched, acyclic, alkyl or alkenyl group having from 1 to 12 carbon atoms or $—(R^4—O)_m—H$ wherein each m is independently an integer ranging from 1 to 6, preferably from 1 to 4, more preferably from 1 to 2, even more preferably m is equal to 1 and $R^4$ is a divalent linear or branched, acyclic, alkyl or alkenyl group having from 1 to 12 carbon atoms, preferably from 2 to 6 carbon atoms.

According to an embodiment, in formula (I):

n ranges from 1 to 2, $R^1$ is a divalent linear or branched alkyl group having from 2 to 6 carbon atoms, preferably from 2 to 4 carbon atoms, $R^2$ and $R^3$, identical or different, preferably identical, are selected from a hydrogen atom, a linear or branched alkyl group having from 2 to 6 carbon atoms, preferably from 2 to 4 carbon atoms, or from $—(R^4—O)_m—H$ wherein each m is independently an integer ranging from 1 to 2, and $R^4$ is a divalent linear or branched alkyl group having from 2 to 6 carbon atoms, preferably from 2 to 4 carbon atoms.

According to an embodiment, if $R^4$ is present in formula (I), $R^4$ is preferably identical to $R^1$.

According to an embodiment, the molecular weight of the alkanolamine is less than or equal to 300 g/mol, preferably less than or equal to 250 g/mol, more preferably less than or equal to 200 g/mol. According to an embodiment, the molecular weight of the alkanolamine ranges from 50 to 300 g/mol, preferably from 55 to 250 g/mol, more preferably from 60 to 200 g/mol.

According to a particular embodiment, in the alkanolamine of formula (I):

n is equal to 2 and at least one among $R^2$ and $R^3$ is —$(R^4—O)_m$—H wherein m is 1 or 2, preferably both $R^2$ and $R^3$ are —$(R^4—O)_m$—H wherein m is preferably 1.

According to an embodiment, the alkanolamine is selected from methyldiethanolamine, monoisopropanolamine, polyethanolamine, monoethanolamine, diethanolamine, methylmonoethanolamine, dimethylethanolamine, diethylethanolamine, ethylmonoethanolamine, ethyldiethanolamine, triisopropanolamine, and mixtures thereof. Preferably, the alkanolamine is selected from methyldiethanolamine, monoisopropanolamine, polyethanolamine, monoethanolamine, diethanolamine, and mixtures thereof, more preferably from methyldiethanolamine, monoisopropanolamine, polyethanolamine, monoethanolamine and mixtures thereof.

The alkanolamines of formula (I) are commercially available.

According to the invention, the oxazolidine compound and the alkanolamine are present in respective amounts such that the weight ratio oxazolidine/alkanolamine is higher than 1. Preferably, the weight ratio oxazolidine/alkanolamine ranges from more than 1 to 20, preferably from 1.2 to 15, more preferably from 1.5 to 10, even more preferably from 2 to 5.

According to an embodiment, the alkanolamine represents from 0.5 to less than 50% wt, preferably from 1 to 45% wt, even more preferably from 1.5 to 40% wt, more preferably from 2 to 30% wt, of the total weight of the composition, and/or the oxazolidine compound represents from 10 to 99% wt, preferably from 30 to 98% wt, even more preferably from 40 to 95% wt of the total weight of the composition.

According to an embodiment, the composition further comprises at least one solvent.

Preferably, the solvent is selected from poly alkyl ethers, aliphatic or aromatic solvents, such as N-methylpyrrolidone, butyl carbitol, xylene, toluene, and benzene. It has been observed that the scavenging efficiency of the compositions of the invention is not dependent on the solvent. However, depending on the final use of the scavenging composition, a solvent having a dual solubility, i.e. a water solubility and a solubility in hydrocarbons, can be preferred. Butyl carbitol is a suitable solvent since it has this dual solubility.

Depending on the solubility of the copolymer and the scavenger, a co-solvent can be used. Among co-solvent, mention may be made of alcohols.

According to this embodiment, the solvent represents from 1 to 85% wt of the composition, preferably from 5 to 80% wt, more preferably from 10 to 70% wt, even more preferably from 20 to 60% wt of the composition.

According to an embodiment of the invention, the composition comprises, preferably consists of:

From 10 to 99% wt, preferably from 30 to 98% wt, more preferably from 40 to 95% wt of bisoxazolidine compound(s), From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition.

According to an embodiment of the invention, the composition comprises, preferably consists of:

From 10 to 99% wt, preferably from 30 to 98% wt, more preferably from 40 to 95% wt of bisoxazolidine compound(s), From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition, wherein the weight ratio of bisoxazolidine to alkanolamine of formula (I) ranges from 1.5 to 10, preferably from 2 to 5.

According to an embodiment of the invention, the composition comprises, preferably consists of:

From 10 to 99% wt, preferably from 30 to 98% wt, more preferably from 40 to 95% wt of MBO, From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition, wherein in formula (I):

n ranges from 1 to 2, $R^1$ is a divalent linear or branched alkyl group having from 2 to 6 carbon atoms, preferably from 2 to 4 carbon atoms, $R^2$ and $R^3$, identical or different, are selected from a hydrogen atom, a linear or branched alkyl group having from 2 to 6 carbon atoms, preferably from 2 to 4 carbon atoms, or from —$(R^4—O)_m$—H wherein each m is independently an integer ranging from 1 to 2, and $R^4$ is a divalent linear or branched alkyl group having from 2 to 6 carbon atoms, preferably from 2 to 4 carbon atoms.

According to an embodiment of the invention, the composition comprises, preferably consists of:

From 10 to 99% wt, preferably from 30 to 98% wt, more preferably from 40 to 95% wt of MBO, From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition, wherein in formula (I):

n is equal to 2 and at least one among $R^2$ and $R^3$ is —$(R^4—O)_m$—H wherein m is 1 or 2, preferably both $R^2$ and $R^3$ are —$(R^4—O)_m$—H wherein m is preferably 1.

According to an embodiment of the invention, the composition comprises, preferably consists of:

From 10 to 99% wt, preferably from 30 to 98% wt, more preferably from 40 to 95% wt of MBO, From 0.5 to less than 50% wt, preferably from 1 to 45% wt, more preferably from 1.5 to 40% wt, even more preferably from 2 to 30% wt of the alkanolamine of formula (I), and Optionally from 5 to 80% wt, preferably from 10 to 70% wt, more preferably from 20 to 60% wt of solvent(s), based on the total weight of the composition, wherein the alkanolamine is selected from methyldiethanolamine, monoisopropanolamine, polyethanolamine, monoethanolamine, diethanolamine, methylmonoethanolamine, dimethylethanolamine, diethylethanolamine, ethylmonoethanolamine, ethyldiethanolamine, triisopropanolamine, and mixtures thereof.

According to an embodiment, the scavenging composition of the invention is substantially free of aldehyde compounds and/or substantially free of acetal compounds and/or substantially free of hemiacetal compounds. Preferably, the scavenging composition of the invention is free of aldehyde compounds and/or free of acetal compounds or free of hemiacetal compounds. The residual amount of aldehyde can be measured by gas chromatography for example on the oxazolidine compound being part of the scavenging composition of the invention.

Within the meaning of the present invention, the expression "substantially free" means an amount of less than 0.02% wt based on the total weight of the composition.

Within the meaning of the present invention, the expression "aldehyde compound" means a compound comprising at least one aldehyde function.

Within the meaning of the present invention, the expression "aldehyde compound" means a compound comprising at least one aldehyde function.

Within the meaning of the present invention, the expression "acetal compound" means a compound comprising at least one acetal function.

Within the meaning of the present invention, the expression "hemiacetal compound" means a compound comprising at least one hemiacetal function.

The present invention also concerns the use of an alkanolamine in order to improve the efficiency of an oxazolidine compound for scavenging hydrogen sulphide ($H_2S$) and/or mercaptans in hydrocarbon streams.

Preferably, the alkanolamine has one or more of the features defined above in relation to the composition of the invention.

Preferably, the oxazolidine compound has one or more of the features defined above in relation to the composition of the invention.

The "alkanolamine" used in the invention is also named the "synergistic additive", since when used in combination with an oxazolidine compound, it can boost the effect of the oxazolidine compound for scavenging H2S and/or mercaptans in hydrocarbon streams.

By hydrocarbon stream is meant either a single-phase hydrocarbon stream or a multiphase system comprising oil/water or oil/water/gas or gas/water.

Preferably, the weight ratio oxazolidine compound(s) to synergistic additive(s) ranges from 1 to 50, preferably from 1 to 25, more preferably from 1,5 to 10, even more preferably from 2 to 5.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

The present invention also concerns the use of the composition defined above as a $H_2S$ and/or mercaptans scavenger in hydrocarbon streams, said hydrocarbon streams being preferably selected from crude oil, fuel, natural gas, Light Petroleum Gas, bitumen and petroleum residue. The composition of the invention is contacted with hydrocarbon streams such as crude oil, fuel, natural gas, bitumen or petroleum residue in order to reduce the amount of hydrogen sulphide ($H_2S$) and mercaptans. Hydrocarbon streams may be selected from crude oils and fuels which typically comprise more than 70% wt of paraffins, preferably more than 90% wt of paraffins and even more preferably more than 95% wt of paraffins, based on the total weight of the crude oils and fuels. Hence, hydrocarbon streams may be selected from crude oils and fuels which typically comprise less than 30% wt of aromatics, preferably less than 10% wt of aromatics and even more preferably less than 5% wt of aromatics, based on the total weight of the crude oils and fuels.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

According to an embodiment of the present invention, the weight ratio $H_2S$:scavenging composition ranges from 1:5 to 1:0:01, preferably from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4. This ratio can be measured by ASTM D 5705 standard. In this ratio, $H_2S$ represents the amount of hydrogen sulphide in the hydrocarbon streams, before contacting with the scavenging composition of the invention.

The invention thus also relates to a method to scavenge H2S and/or mercaptans in a hydrocarbon stream, the method comprising a step of contacting the hydrocarbon stream with the scavenging composition defined in the present invention.

The present invention also concerns hydrocarbon-containing composition comprising hydrocarbons and the scavenging composition of the invention. The hydrocarbon-containing composition considered in the present invention may be either single-phase hydrocarbon streams or multiphase systems comprising oil/water or oil/water/gas or gas/water.

Hydrocarbons may be selected from crude oil, fuel oil, fuel, Light Petroleum Gas, natural gas, bitumen and petroleum residue. Hydrocarbons may be selected from crude oils and fuels which typically comprise more than 70% wt of paraffins, preferably more than 90% wt of paraffins and even more preferably more than 95% wt of paraffins, based on the total weight of the crude oils and fuels. Hence, hydrocarbons may be selected from crude oils and fuels which typically comprise less than 30% wt of aromatics, preferably less than 10% wt of aromatics and even more preferably less than 5% wt of aromatics, based on the total weight of the crude oils and fuels.

Hydrocarbon streams contain $H_2S$ and/or mercaptans, in an amount for example ranging from 1 to 10 000 ppm. Mercaptans that can be removed from hydrocarbon streams within the framework of the present invention may be $C_1$-$C_6$ mercaptans, such as $C_1$-$C_4$ mercaptans.

The scavenging composition of the invention may represent from 0.0005 to 5% by weight of the total weight of the hydrocarbon-containing composition.

According to an embodiment of the present invention, the weight ratio $H_2S$:scavenging composition ranges from 1:2 to 1:0.05, preferably from 1:1 to 1:0.1, more preferably from 1:0.9 to 1:0.2, even more preferably from 1:0.7 to 1:0.3 and advantageously from 1:0.8 to 1:0.4. In this ratio, $H_2S$ represents the amount of hydrogen sulphide of the hydrocarbon streams, before contacting with the scavenging composition of the invention.

EXAMPLES

The invention is now described with the help of the following examples, which are not intended to limit the scope of the present invention, but are incorporated to illustrate advantages of the present invention and best mode to perform it.

Example 1: Description of the Scavenging Compositions Prepared and Tested

Different scavenging compositions have been prepared and tested. The products that have been used are:

MBO=3,3'-methylenebis(5-methyloxazolidine)
MDEA=methyldiethanolamine
MIPA=monoisopropanolamine
PEA=polyethanolamine
MEA=monoethanolamine
BC=butyl carbitol These products are commercially available.

Scavenging compositions are prepared by mixing the ingredients at ambient temperature.

Table 1 below summarizes the scavenging compositions that were tested.

TABLE 1

| Scavenging compositions | | | | |
|---|---|---|---|---|
| | | Synergistic additive | | |
| scavenging composition | MBO (wt %) | alkanolamine | Amount (% wt) | BC (wt %) |
| C1 | 70 | — | 0 | 30 |
| C2 | 0 | MDEA | 30 | 70 |
| C3 | 0 | MIPA | 30 | 70 |
| C4 | 0 | PEA | 30 | 70 |
| C5 | 0 | — | 0 | 100 |
| C6 | 0 | MDEA | 10 | 90 |
| C7 | 0 | MDEA | 20 | 80 |
| C8 | 100 | — | 0 | 0 |
| C9 | 0 | MIPA | 10 | 90 |
| C10 | 0 | MIPA | 20 | 80 |
| I1 | 70 | MDEA | 30 | 0 |
| I2 | 70 | MIPA | 30 | 0 |
| I3 | 70 | PEA | 30 | 0 |
| I4 | 70 | MDEA | 10 | 20 |
| I5 | 70 | MDEA | 20 | 10 |
| I6 | 70 | MEA | 30 | 0 |
| I7 | 70 | MIPA | 20 | 10 |
| I8 | 70 | MIPA | 10 | 20 |

Example 2: Measurement of $H_2S$ Scavenging Ability of the Scavenging Compositions In these examples, the scavenging compositions that are tested are compositions C1-C7 and I1-I5 of table 1. Each composition had been introduced into a hydrocarbon stream in order to test the performances of each composition.

In a typical experiment, dry $H_2S$ gas with 50 ppm of concentration being passed through the hydrocarbon media, with 0.3 L/min flow rate and 1.5 psi pressure. The $H_2S$ scavenger being dosed into gas purging bottle, typically being charged with 100 mL of hydrocarbon media. The outlet of this gas purging botte is passed through the gas scrubber. The gas scrubber typically scrubs all the gases and vapor apart from $H_2S$ and allows to pass only $H_2S$ gas to the detector. The detector shows the actual concentration of $H_2S$ in real time throughout the experiment. Finally, the outlet from the $H_2S$ detector is passed through aq. NaOH solution in order to neutralize the $H_2S$ gas.

The test had been performed in two hydrocarbon streams:

HC1=a dearomatized hydrocarbon solvent having an initial boiling point higher than 120° C., a final boiling point lower than 250° C. (the difference between the final boiling point and the initial boiling point ranges from 20 to 35° C.) and a flash point above 65° C. with aromatic content less than 0.1% wt and a paraffin content of more than 75% wt.

HC2=a dearomatized hydrocarbon solvent having an initial boiling point higher than 120° C., a final boiling point higher than 250° C. (the difference between the final boiling point and the initial boiling point ranges from 40 to 50° C.) and a flash point above 100° C. with aromatic content less than 0.05% wt and a paraffin content of more than 75% wt.

The following protocol had been implemented:

1. Transfer 100 mL of hydrocarbon solvent (HC2 detailed above) to gas-purging bottle. Fit the fritted glass bubbler at the opening of the bottle. Assemble the gas purging bottle/glass frit apparatus. Place the bottle into the oil bath.
2. Fit one end of the Tygon tube at the outlet of the $H_2S$ gas cylinder, and its another end to a gas flowmeter. Connect the outlet of the gas flowmeter to inlet of the fritted glass bubbler using Tygon tube. Outlet of the condenser will be connected to gas scrubber, to ensure all the other gases get trapped and only $H_2S$ goes to the detector.
3. Finally, outlet of the detector is attached to $H_2S$ neutralizing unit which contains aq. NaOH solution.
4. Start the flow of $H_2S$ gas with 50 ppm concentration in $N_2$. Ensure that the pressure maintain to 0.3 L/min all the times, with 1.5 psi pressure.
5. Purge the content of the gas purging bottle for at least 15-20 min, to remove all the dissolved oxygen, and till constant 50 ppm reading is shown at $H_2S$ detector.
6. Once the constant 50 ppm concentration is displayed at $H_2S$ detector, measured quantity of the $H_2S$ scavenger to be injected using syringe through the $H_2S$ scavenger dosing point into the hydrocarbon media present in the gas purging bottle.
7. $H_2S$ detector is inbuild with data logger which save the readings after every 5 seconds delay.
8. Upon completion of the experiment, typically being run for 30 min. The $H_2S$ detector is connected to computer to retrieve the data.

The $H_2S$ amount in ppm in function of the time had been measured and is shown in FIG. 1 to FIG. 6.

Figure 2:
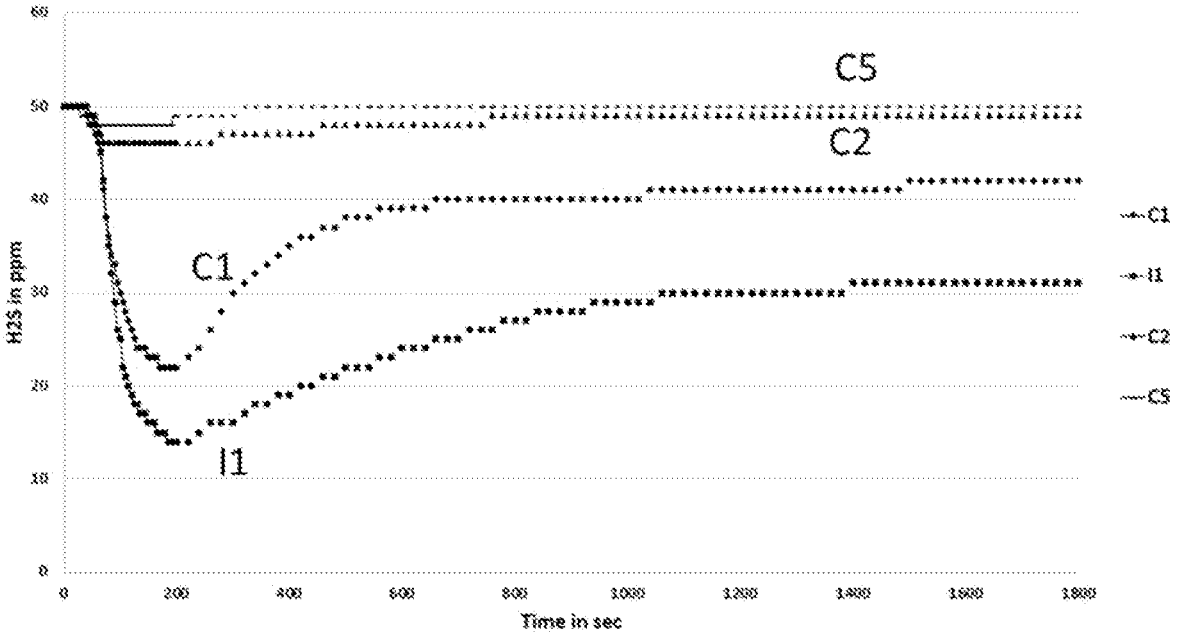
FIG. 2 represents the amount of hydrogen sulphide in ppm in function of the time during the test for different scavenging compositions in a hydrocarbon stream (HC2).
Figure 3:
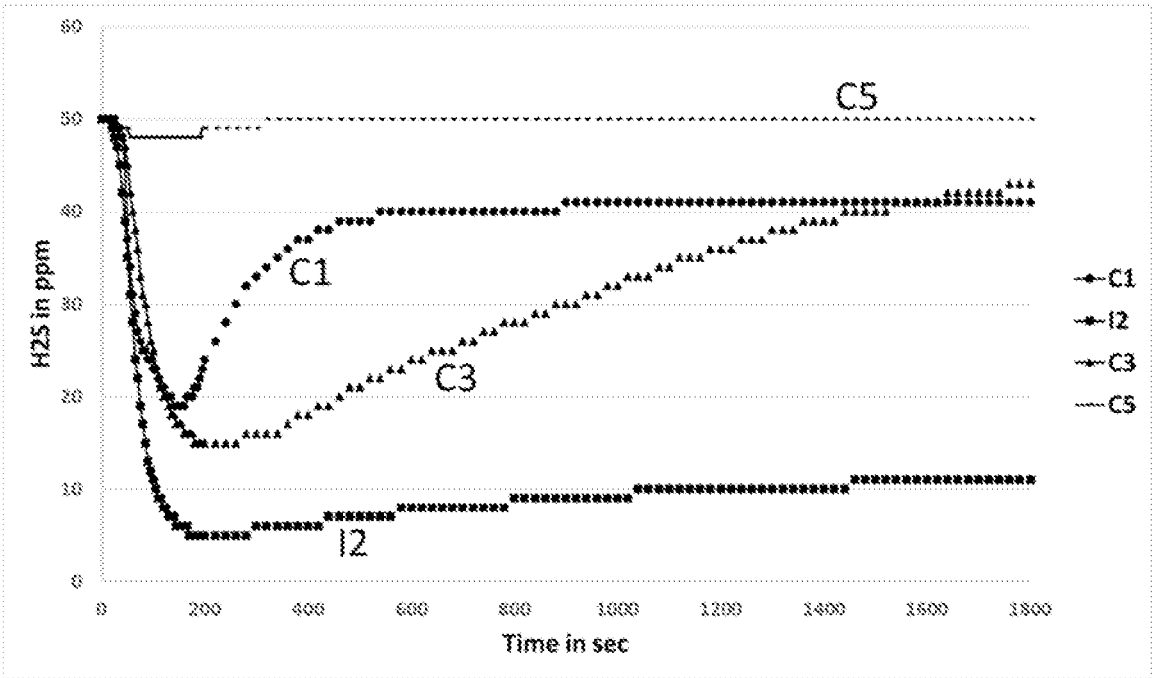
FIG. 3 represents the amount of hydrogen sulphide in ppm in function of the time during the test for different scavenging compositions in a hydrocarbon stream (HC1).
Figure 4:
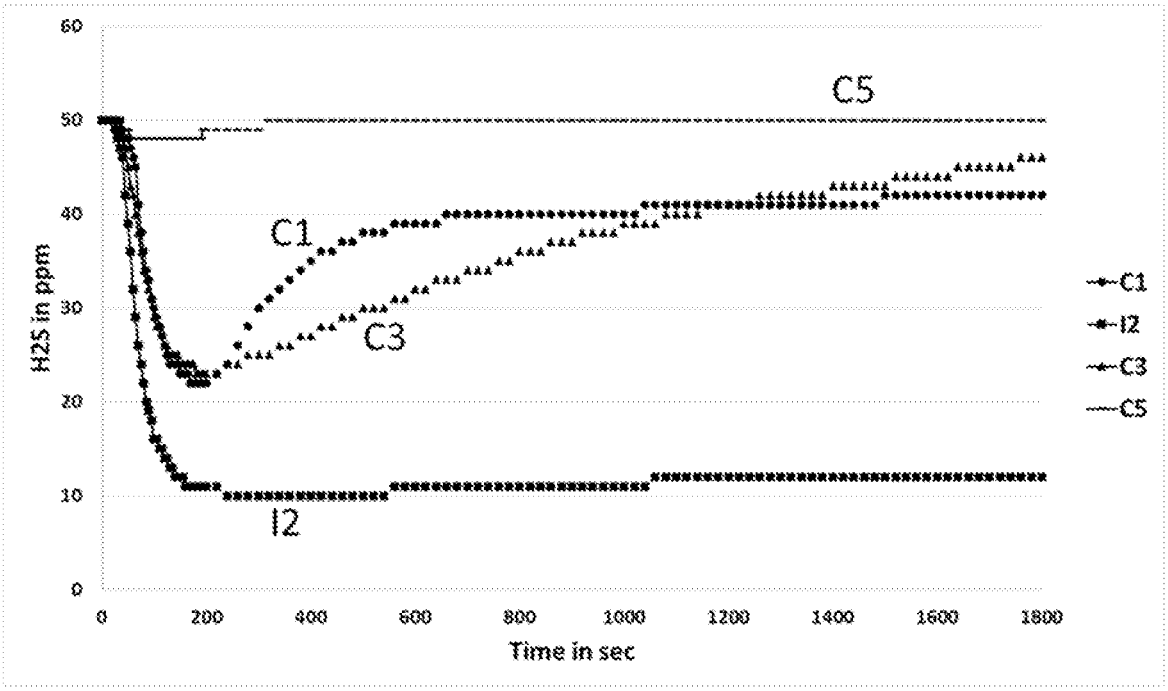
FIG. 4 represents the amount of hydrogen sulphide in ppm in function of the time during the test for different scavenging compositions in a hydrocarbon stream (HC2).
Figure 5:
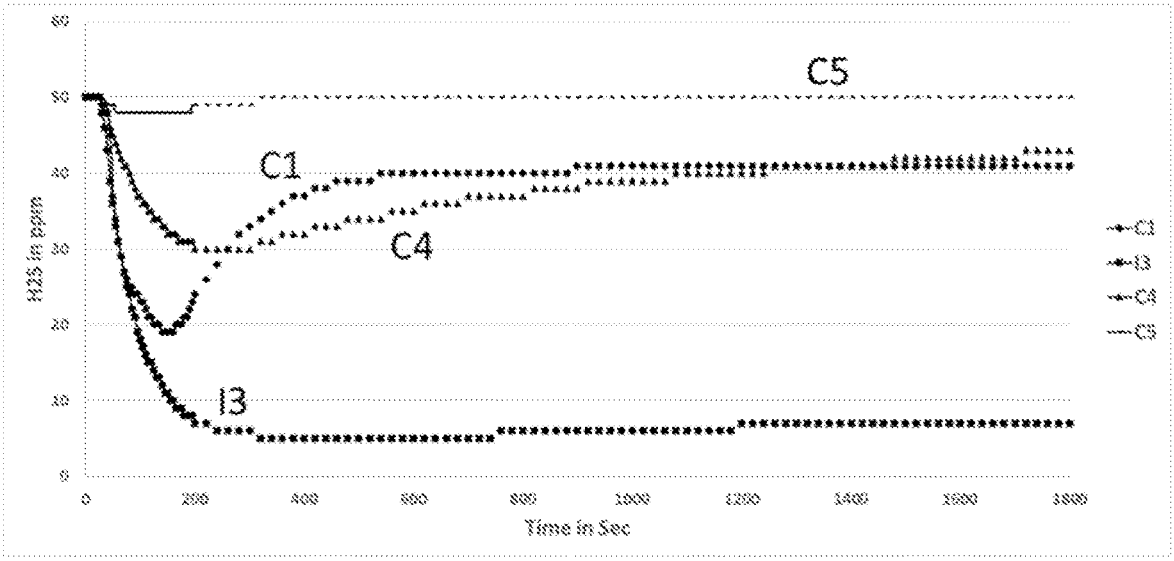
FIG. 5 represents the amount of hydrogen sulphide in ppm in function of the time during the test for different scavenging compositions in a hydrocarbon stream (HC1).
Figure 6:
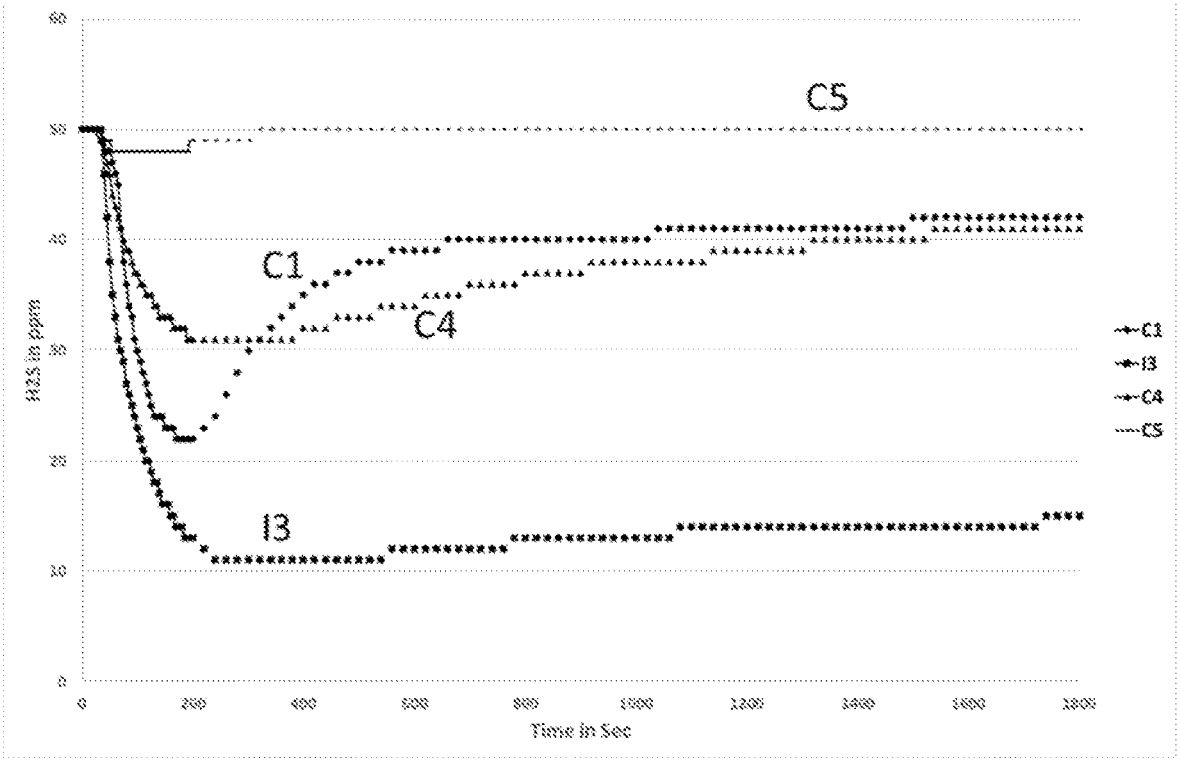
FIG. 6 represents the amount of hydrogen sulphide in ppm in function of the time during the test for different scavenging compositions in a hydrocarbon stream (HC2).

FIG. 1, FIG. 3 and FIG. 5 represent the results in hydrocarbon stream HC1 and FIG. 2, FIG. 4 and FIG. 6 represent the results in hydrocarbon stream HC2.

As can be seen in FIG. 1 and FIG. 2, the alkanolamine MDEA alone had a very limited effect on the scavenging of $H_2S$, whereas the combination I1 according to the invention comprising MBO and MDEA had a much-improved scavenging performances showing the synergistic effect of the claimed combination. In particular, the scavenging effect is faster and is higher with the combination I1 according to the invention than with compositions C1, C2 and C5 outside of the invention.

As can be seen in FIG. 3, FIG. 4, FIG. 5, FIG. 6, the alkanolamines MIPA and PEA alone had an effect on the scavenging of $H_2S$ but this effect does not last over time since the amount of $H_2S$ first decreases but then increases to an amount of more than 40 ppm after 1800 seconds, while $H_2S$ is continuously added during the test. On the contrary, it can be seen that the combinations 12 and 13 according to the invention comprising MBO and MIPA or PEA had a much-improved scavenging performances showing the synergistic effect of the claimed combination. It can additionally be noted that the $H_2S$ scavenging effect is maintained over time, since the amount of $H_2S$ is lower than 20 ppm or even lower than 15 ppm after 1800 seconds for the scavenging compositions 12 and 13 according to the invention, while $H_2S$ is continuously added during the test.

Figure 7:
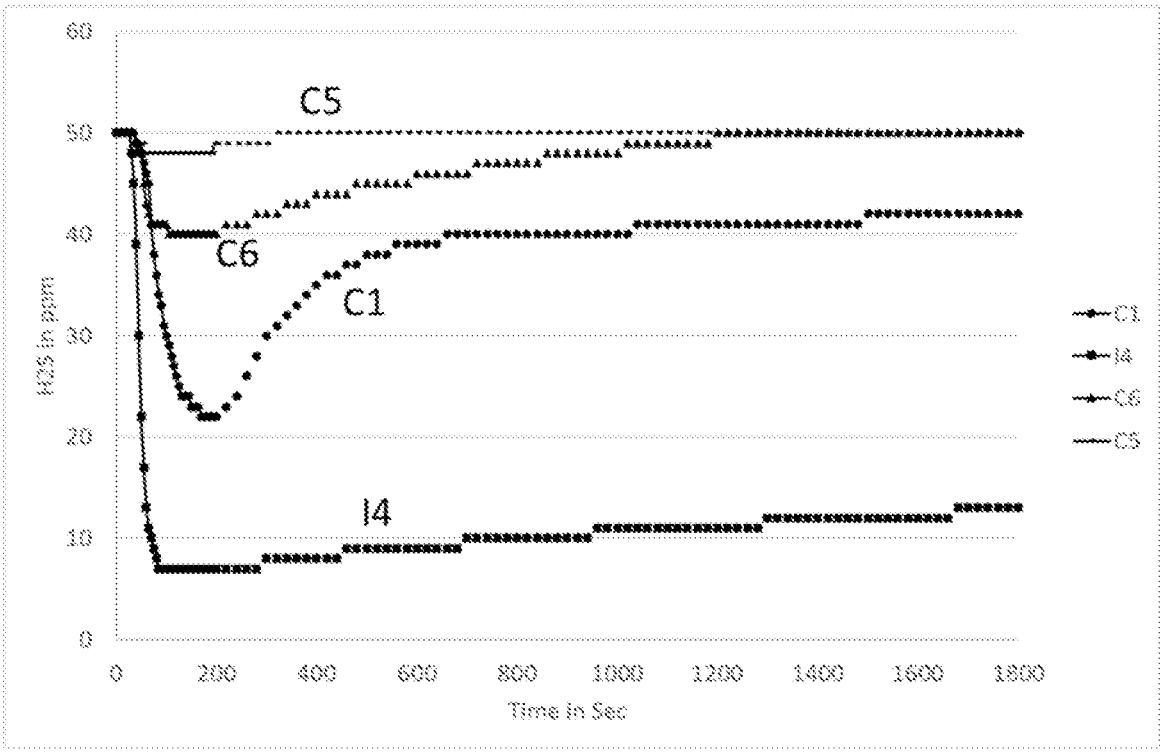
FIG. 7 represents the amount of hydrogen sulphide in ppm in function of the time during the test for different scavenging compositions in a hydrocarbon stream (HC2).
Figure 8:
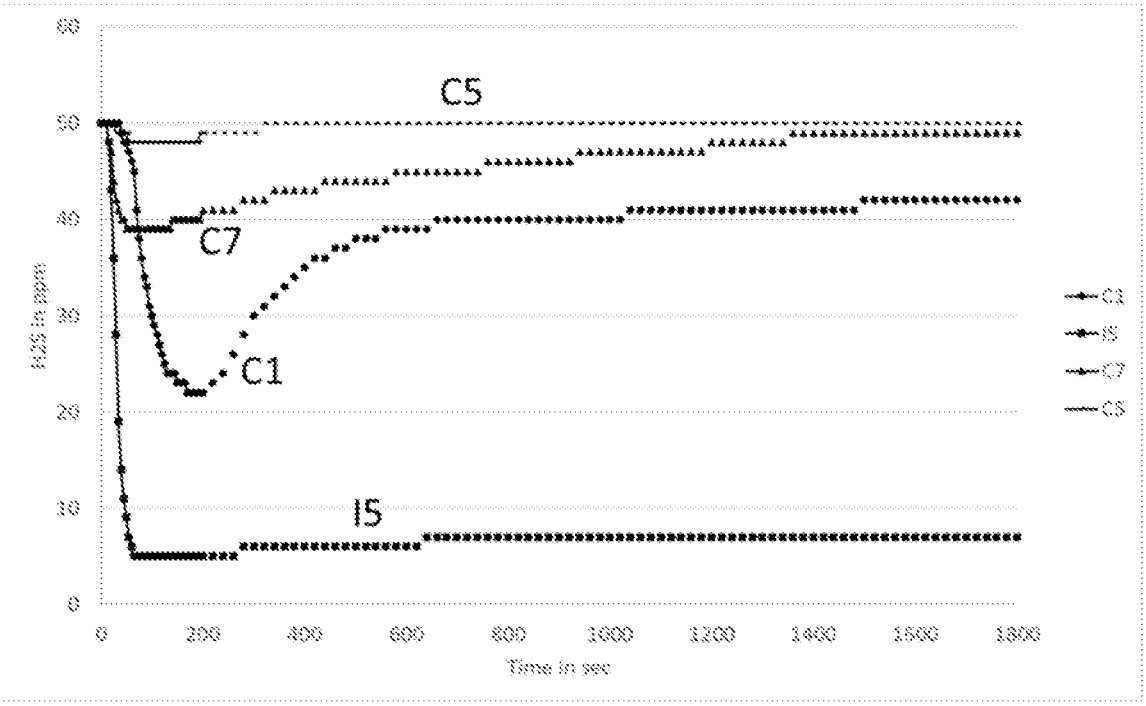
FIG. 8 represents the amount of hydrogen sulphide in ppm in function of the time during the test for different scavenging compositions in a hydrocarbon stream (HC2).

FIG. 7 and FIG. 8 further show that scavenging compositions also comprising a solvent still have very satisfying properties. The results of these figures also demonstrate that increasing the weight ratio oxazolidine compound/alkanolamine allows to increase the scavenging efficiency and in particular the speed of scavenging.

As demonstrated by the examples, the alkanolamine defined in the invention allows to boost the efficiency of the oxazolidine compound. Indeed, the scavenging compositions of the invention I1, I2, I3, I4 and I5 comprising the combination of the alkanolamine and of the oxazolidine compound allow to significantly reduce the $H_2S$ amount in the hydrocarbon stream, since the amount of $H_2S$ with the combination is much lower than the amount of H2S with the alkanolamine alone (scavenging compositions C2, C3, C4, C6, C7) or than the amount of $H_2S$ with the oxazolidine compound alone (scavenging composition C1). The composition of the invention also allows to increase the speed of scavenging and to increase the amount of $H_2S$ that can be scavenged for a given amount of scavenger.

Example 3: Measurement of $H_2S$ Scavenging Ability of the Scavenging Compositions in a Gas Phase Three $H_2S$ scavengers were evaluated for scavenging performance in gas phase measurement performance tests. A mixture of brine and an isoparaffinic hydrocarbon product in a weight ratio 50/50 was prepared. The isoparaffinic hydrocarbon product comprises 25% wt of a C11-C13 isoparaffinic cut and 75% wt of a C12-C16 isoparaffinic cut. The mixture was heated to the test temperature (25° C.) before being saturated by sparging with $H_2S$ gas in nitrogen (50 ppm) until equilibrium was achieved in the gas phase. The flow of $H_2S$ was stopped, the stirrer started (stirring rate of 300 rpm) and the $H_2S$ scavenger added to the aqueous phase in a concentration of 125 ppmv. The concentration of $H_2S$ in the gas phase was logged every 10 s for up to 2 hours (or until 1 ppm is measured) and the time required to reduce the gaseous H2S concentration to 10 ppmv was determined.

The H2S scavengers tested in this example are compositions C8, I1 and I6 detailed in table 1.

Figure 9:
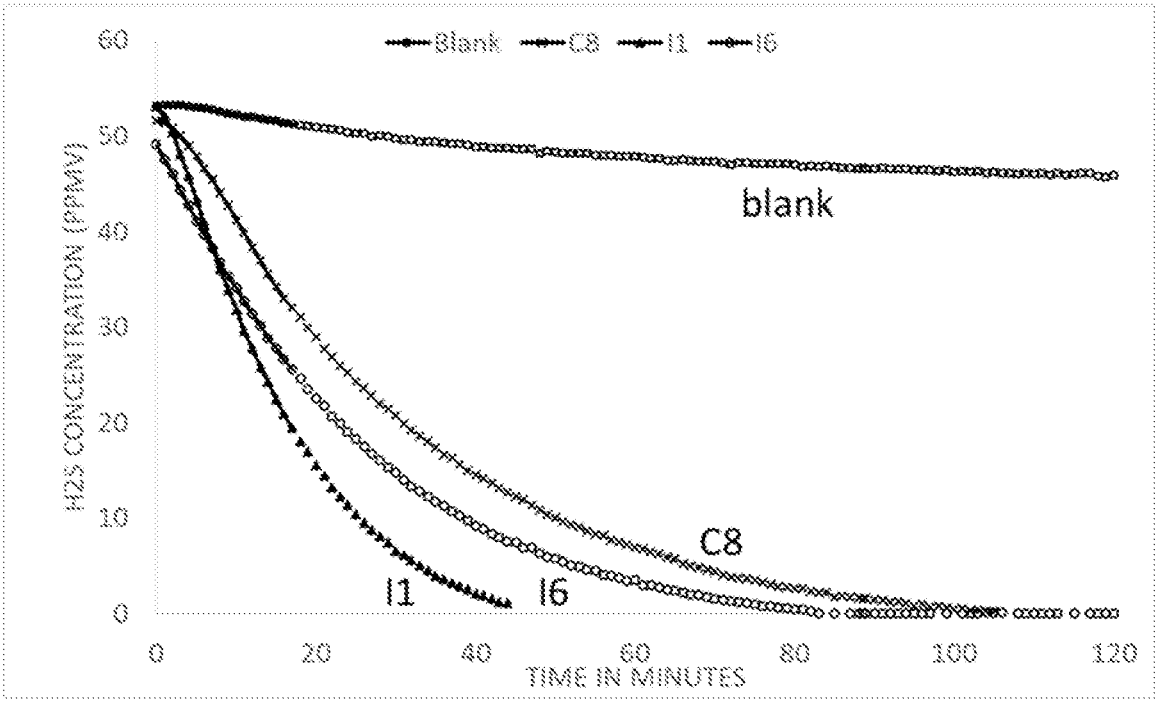
FIG. 9 represents the amount of hydrogen sulphide in ppmv in function of the time during the test in a gas phase for different scavenging compositions.

FIG. 9 shows the concentration of H2S in ppmv in the gas phase in function of the time in minutes. The Blank measurement corresponds to the same test, but without addition of the $H_2S$ scavenger. As illustrated in FIG. 7, the time needed to reach a $H_2S$ concentration of 10 ppm is of about 50 minutes for the composition C8 comprising only MBO and if of about 40 minutes for the composition 16 and of about 25 minutes for the composition I1. Thus, the scavenging compositions of the invention comprising an oxazolidine compound and an alkanolamine compound provide a faster scavenging effect when compared to a composition comprising only an oxazolidine compound.

Example 4: Measurement of $H_2S$ Scavenging Ability of the Scavenging Compositions In this example, the $H_2S$ scavenging ability had been evaluated according to ASTM D5705 standard. ASTM D-5705 can be used for measurement of Hydrogen sulfide in a vapor phase above the residual fuel oils (hydrocarbon streams). Performance evaluation of various scavenging compositions were evaluated using a modified ASTM D-5705 test method as detailed below:

In a typical experiment, 1 liter tin metal bottles with inner and outer caps were used to prepare and hold the test media. The hydrocarbon media named "HC2" detailed above has been used for the tests of this example.

In a representative experimental set, a defined amount of $H_2S$ saturated hydrocarbon solvent, typically between 2000 and 7000 ppm by weight of $H_2S$, was injected in 1 liter tin metal bottle pre-filled with 500 ml of dearomatized hydrocarbon solvent through the silicon septa fixed at the opening of the bottle using micro-syringe. The metal bottle was then kept on a reciprocating shaking machine for 5 min to allow proper mixing of the $H_2S$ gas. The tin metal bottle was then kept in a water bath at 60° C. for two hours. After two hours, the tin metal bottle was taken out and cooled down to room temperature under running tap water and kept aside. An $H_2S$ detecting tube (Drager tube, with typical detection limit ranging from 100 to 70 000 ppm by weight) was inserted in a rubber cork through a hole having the same diameter as the detecting tube. The sealed ends of the $H_2S$ detecting tube were opened with an appropriate opener, one end of the tube being attached to Drager pump. The silicon septa mounted at the opening of the tin metal bottles was removed and very quickly the rubber cork with $H_2S$ detector tube was inserted inside the opening of the tin metal bottle. The $H_2S$ gas in the vapor phase of the tin metal bottle was then pulled through the $H_2S$ measuring tube using Drager pump attached at the other end of the tube. The detector tube was removed after complete decompression of the pump. $H_2S$ concentration was read from the tubes calibration scale (typically color change from colorless to brown). This reading was noted as a reference Blank reading of $H_2S$ amount.

Further, same amount of $H_2S$ containing dearomatized hydrocarbon solvent was injected into other tin metal bottles, which are pre-filled with 500 mL of the dearomatized hydrocarbon, and $H_2S$ scavengers at different ratios of scavenger against $H_2S$, based on the Blank reading. Typical $H_2S$:scavenger ratios employed were 1:1, 1:0.8, 1:0.6, 1:0.4, 1:0.2 and 1:0.1. All the metal bottles were kept in a water bath for two hours at 60° C. Similar protocol was employed to measure the $H_2S$ in the vapor phase of all the bottles as used to make the Blank reading. The difference between the Blank $H_2S$ concentration and $H_2S$ concentration observed with different concentrations of the scavenging products and formulations are noted as % scavenging. A higher % Scavenging with lower concentration of the scavenging product is considered as better $H_2S$ scavenger for the set of experiment.

The protocol of measurement was repeated three times with each scavenging composition and the indicated percentage was calculated based on the average of the measurements.

The scavenging compositions tested are those detailed in table 1 above.

Table 2 below shows the percentage of $H_2S$ reduction based on the measured $H_2S$ amount in vapour phase after treatment with the $H_2S$ scavenging compositions.

TABLE 2

Scavenging efficiency (% of $H_2S$ reduction) of the scavenging compositions

| | % Scavenging Efficiency v/s Scavenger Dosages [modified ASTM D5705] | | | | | |
|---|---|---|---|---|---|---|
| Ref | 1:1 | 1:0.8 | 1:0.6 | 1:0.4 | 1:0.2 | 1:0.1 |
| I1 | 100 | 100 | 100 | 80 | 60 | 20 |
| I2 | 100 | 100 | 100 | 100 | 100 | 100 |
| I4 | 100 | 100 | 100 | 92 | 70 | 50 |
| I5 | 100 | 100 | 100 | 90 | 60 | 40 |
| I7 | 100 | 100 | 100 | 100 | 100 | 80 |
| I8 | 100 | 100 | 100 | 100 | 95 | 60 |
| C1 | 100 | 100 | 90 | 60 | 40 | 10 |
| C2 | 100 | 100 | 90 | 60 | 10 | 0 |
| C3 | 100 | 100 | 100 | 100 | 80 | 30 |
| C6 | 70 | 90 | 0 | 0 | 0 | 0 |
| C7 | 100 | 90 | 60 | 20 | 0 | 0 |
| C9 | 100 | 100 | 95 | 60 | 20 | 0 |
| C10 | 100 | 100 | 100 | 95 | 60 | 20 |

The results in Table 2 clearly show that the scavenging compositions of the present invention are extremely efficient to scavenger hydrogen sulphide in the hydrocarbon-containing media.

For each alkanolamine, it can be observed that the combination of the oxazolidine compound and of the alkanolamine provides a much improved scavenging efficiency than the oxazolidine compound alone and than the alkanolamine alone.

As an example, for the composition 12 according to the invention (comprising MIPA as alkanolamine), 100% of the $H_2S$ present in the hydrocarbon is scavenged even when the weight ratio $H_2S$:scavenging composition is of 1:0.1. On the contrary, if we consider composition C3 comprising MIPA without the oxazolidine compound, when the weight ratio $H_2S$:scavenging composition is of 1:0.1, only 30% wt of $H_2S$ are scavenged.

These results show a synergistic effect obtained thanks to the combination of the oxazolidine compound and of the alkanolamine as defined in the invention.

The invention claimed is:

1. A composition for scavenging hydrogen sulphide and mercaptans in hydrocarbon streams, said composition comprising at least one oxazolidine compound and at least one alkanolamine of formula (I), wherein the weight ratio oxazolidine compound/alkanolamine is higher than 1, wherein:

(I)

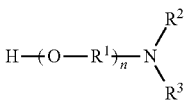

wherein n is an integer ranging from 1 to 6, $R^1$ is a divalent linear or branched, cyclic or acyclic, alkyl or alkenyl group having from 1 to 12 carbon atoms, $R^2$ and $R^3$, identical or different, are selected from a hydrogen atom, a linear or branched, cyclic or acyclic, alkyl or alkenyl group having from 1 to 12 carbon atoms or $—(R^4—O)_m—H$ wherein each m is independently an integer ranging from 1 to 6 and $R^4$ is a divalent linear or branched, acyclic or cyclic, alkyl or alkenyl group having from 1 to 12 carbon atoms.

2. The composition according to claim 1, wherein the weight ratio oxazolidine compound/alkanolamine ranges from more than 1 to 20.

3. The composition according to claim 1, wherein the oxazolidine compound is selected from bisoxazolidines of formula (II):

(II)

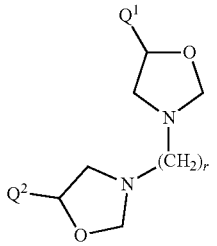

Wherein r is an integer ranging from 1 to 6;

$Q^1$ and $Q^2$, identical or different, are selected from a hydrogen atom and a linear, branched or cyclic alkyl or alkenyl groups having from 1 to 6 carbon atoms.

4. The composition according to claim 1, wherein in formula n ranges from 1 to 2, $R^1$ is a divalent linear or branched alkyl group having from 2 to 6 carbon atoms, $R^2$ and $R^3$, identical or different, are selected from a hydrogen atom, a linear or branched alkyl group having from 2 to 6 carbon atoms, or from $—(R^4—O)_m—H$ wherein each m is independently an integer ranging from 1 to 2, and $R^4$ is a divalent linear or branched alkyl group having from 2 to 6 carbon atoms.

5. The composition according to claim 1, wherein the molecular weight of the alkanolamine ranges from 50 to 300 g/mol.

6. The composition according to claim 1, wherein in formula (I):

n is equal to 2 and at least one among $R^2$ and $R^3$ is $—(R^4—O)_m—H$ wherein m is 1 or 2.

7. The composition according to claim 1, wherein the alkanolamine is selected from methyldiethanolamine, monoisopropanolamine, polyethanolamine, monoethanolamine, diethanolamine, methylmonoethanolamine, dimethylethanolamine, diethylethanolamine, ethylmonoethanolamine, ethyldiethanolamine, triisopropanolamine, and mixtures thereof.

8. The composition according to claim 1, further comprising at least one solvent.

9. The composition according to claim 8, wherein the solvent represents from 10 to 70 % wt of the total weight of the composition.

10. The composition according to claim 1, comprising:

From 10 to 99% wt of oxazolidine compound(s),

From 0.5 to less than 50% wt of the alkanolamine of formula (I), and

Optionally from 5 to 80% wt of solvent(s), based on the total weight of the composition.

11. The composition according to claim 1, comprising:

From 10 to 99 % wt of oxazolidine compound(s),

From 0.5 to less than 50% wt of the alkanolamine of formula (I), and

Optionally from 5 to 80% wt of solvent(s), based on the total weight of the composition, wherein the weight ratio of oxazolidine compound to alkanolamine of formula (I) ranges from 1.5 to 10.

12. Hydrocarbon-containing composition comprising hydrocarbons and a composition according to claim 1.

13. Hydrocarbon-containing composition according to claim 12, wherein the hydrocarbons are selected from crude oil, fuel oil, fuel, Light Petroleum Gas, natural gas, bitumen and petroleum residues.

14. A method for scavenging hydrogen sulphide and/or mercaptans in a hydrocarbon stream, comprising contacting the hydrocarbon stream with the composition according to claim 1.

15. The composition according to claim 1, wherein in formula (I):

n is equal to 2 and both $R^2$ and $R^3$ are $—(R^4—O)_m—H$ wherein m is 1 or 2.

16. The composition according to claim 1, wherein the alkanolamine is selected from methyldiethanolamine, monoisopropanolamine, polyethanolamine, monoethanolamine, diethanolamine, and mixtures thereof.

17. A process for improving the efficiency of an oxazolidine compound for scavenging hydrogen sulphide and/or mercaptans in hydrocarbon streams, the process comprising mixing an alkanolamine of formula (I), with the oxazolidine compound, wherein:

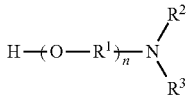

(I)

wherein n is an integer ranging from 1 to 6, $R^1$ is a divalent linear or branched, cyclic or acyclic, alkyl or alkenyl group having from 1 to 12 carbon atoms, $R^2$ and $R^3$, identical or different, are selected from a hydrogen atom, a linear or branched, cyclic or acyclic, alkyl or alkenyl group having from 1 to 12 carbon atoms or $—(R^4—O)_m—H$ wherein each m is independently an integer ranging from 1 to 6 and $R^4$ is a divalent linear or branched, acyclic or cyclic, alkyl or alkenyl group having from 1 to 12 carbon atoms, wherein the weight ratio oxazolidine compound/alkanolamine is higher than 1.

* * * * *